US006076677A

United States Patent [19]

Pozzo

[11] Patent Number: 6,076,677

[45] Date of Patent: Jun. 20, 2000

[54] PACKAGING SYSTEM AND INFLATABLE PACKAGING CUSHION

[75] Inventor: Michel Pozzo, Nevilly S/Seine, France

[73] Assignee: Sealed Air Corporation (U.S.), Saddle Brook, N.J.

[21] Appl. No.: 09/089,524

[22] Filed: Jun. 3, 1998

[51] Int. Cl.[7] ..... B65D 81/03

[52] U.S. Cl. ..... 206/522; 383/3

[58] Field of Search ..... 206/521, 522, 206/590–594; 383/3

[56] References Cited

U.S. PATENT DOCUMENTS 2,915,208 12/1959 Benschoter ..... 206/597
5,348,157 9/1994 Pozzo .
5,588,533 12/1996 Farison et al. .
5,620,096 4/1997 Pozzo .
5,762,197 6/1998 Farison ..... 206/522

*Primary Examiner*—Jim Foster
*Attorney, Agent, or Firm*—Alston & Bird LLP

[57] ABSTRACT

There is provided a packaging system which includes a shipping container, such as a corrugated box, and an inflatable packaging cushion of flexible material adapted to be at least partially charged with filler medium and adapted to the shape and dimension of said packaging container. The inflatable cushion has corners and an internal opening capable of receiving the article to be protected such that the sides and ends of the article are completely encircled within protecting portions of the cushion. The top and bottom of the article are protected by a first pair of inflatable arms extending inwardly into the area of the internal opening and adapted to be positioned above and in contact with said article and a second pair of inflatable arms adapted to be positioned underneath and in contact with said article.

8 Claims, 7 Drawing Sheets

FIG. 5.
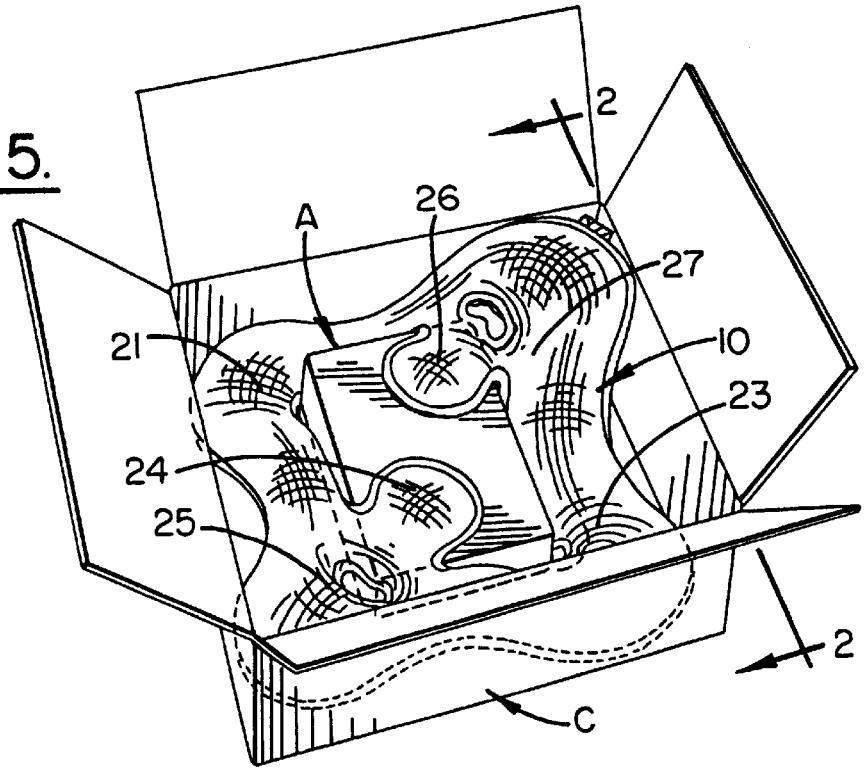
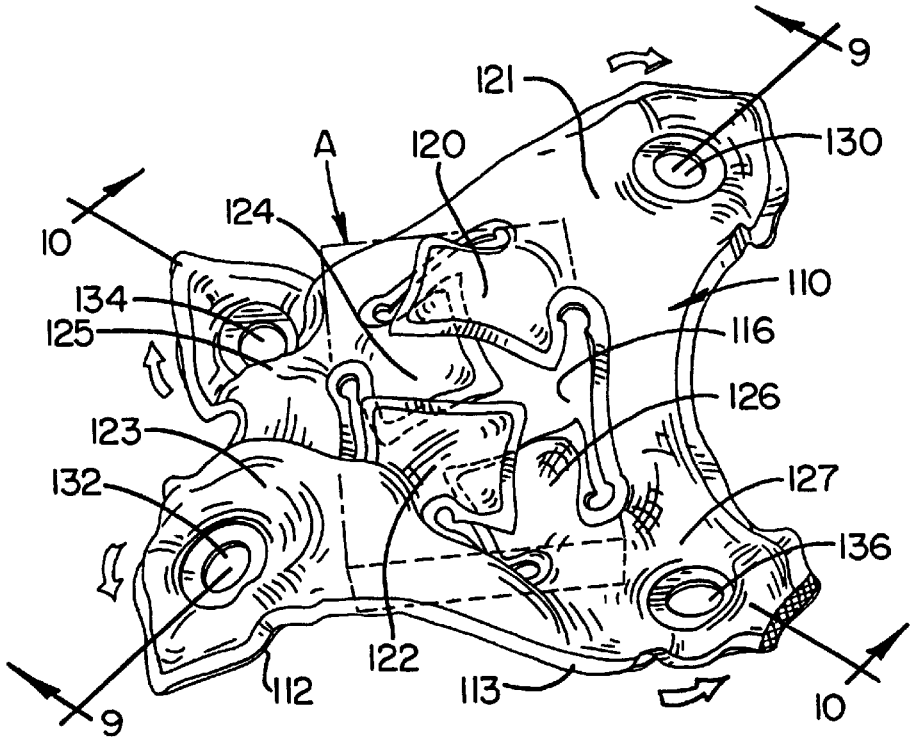
FIG. 6.

PACKAGING SYSTEM AND INFLATABLE PACKAGING CUSHION

FIELD OF THE INVENTION

The present invention relates to a packaging system and to inflatable packaging cushions. More particularly, the present invention relates to a packaging system using an inflatable packaging cushion which cushions all surfaces of an article and is especially adaptable to relatively thin articles.

BACKGROUND OF THE INVENTION

Protective packaging is used during shipping of fragile articles. There are numerous types and forms of packaging material for this purpose including wastepaper, embossed paper, laminated bubble paper and plastic beads, known as peanuts. These forms of cushioning material, while providing certain cushioning, do not always provide the cushioning needed when shipping. These packaging materials also frequently present waste disposal problems upon unpacking the articles.

Positive strides in better packaging have been developed using inflatable packaging material such as that shown in U.S. Pat. No. 5,348,157 to Pozzo which discloses various forms of inflatable packaging cushion serving to protect one or more sides and/or ends of an article. In addition, U.S. Pat. No. 5,588,533 provides a design similar to some of the earlier inflatable packaging designs but having improved features, for example, providing the ability to protect articles on the sides and ends. In another example of inflatable packaging cushions, U.S. Pat. No. 5,620,096 discloses an inflatable cushion intended to protect the top and bottom of an article during shipping.

While various packaging cushions have been developed which adequately protect portions of an article, many articles have the largest surfaces to be protected on their top and bottom yet also need to be protected on the sides and ends. It is difficult to satisfy performance requirements simply by dealing with the top and the bottom surfaces of an article; whereas, when just considering the sides and ends, an article can be supported in a box using multiple edges as support as opposed to a flat surface which is more representative of what is in contact with the top and the bottom of the product.

Even with these improvements there remains a desire to have packaging that provides cushioning to the top and bottom of an article as well as the sides and ends. In addition, it is desirable to provide an inflatable cushion that is easy for the packaging operator to load as well as easy to unpack after shipping.

SUMMARY OF THE INVENTION

It is an object of the present invention to provide a single inflatable packaging cushion for protecting all the sides, ends, top and bottom of an article.

Another object of the present invention is to provide an inflatable packaging cushion which is easy to load and easy to unload with the article to be protected.

A further object of the present invention is to provide an inflatable packaging cushion which is inflated through a single valve or other filling means and protects all surfaces of an article.

Yet another object of this invention is to provide an inflatable cushion which is particularly adapted to meet the unique requirements of protecting a computer hard disk drive.

It has been found that the foregoing objects are accomplished in accordance with this invention by providing a cushion formed of a pair of thermoplastic sheets that have been juxtaposed one over the other, heat sealed around their peripheral edges, include a means of inflation and cut to the desired shape and size. The cushion is designed so that it may be inflated through a single inflation valve or other inflation means. The cushion may take numerous forms and shapes but is, in general, of such size that when inflated and containing an article within its confines contacts and provides protection on all six sides of the product. The article cannot slip out of the cushion, even during rough handling. The inflated cushion is designed to fit snugly within a shipping container.

The cushion has an open area in its inner portion into which extend inwardly two pairs of arms. When the cushion is inflated, the pairs of arms are adapted to have one pair of arms in contact with the top of the article and the second pair of arms underneath and in contact with the bottom of the article thereby snugly fitting the article within the open area. In one embodiment of the invention, the second pair of arms may be connected to each other by a tie strap. The outer areas of the cushion near the corners are somewhat larger in volume of air than are each of the arms. This cushion protects all surfaces of the article.

While protecting the top and the bottom of the article, the inflatable cushion of the subject invention transfers air within the structure easily and rapidly, which is a critical part of the success of the product. For example, if there is too much of a bottleneck for the air to flow then one actually minimizes and reduces the amount of protection afforded the product.

The arms of the cushion which hold the article in place serve to interlock the cushion on the article similar to the gripping action of a paper clip. The transition from the flat configuration after the cushion has been inflated to the position of confining an article, i.e., the interlocking configuration, creates a diagonal tension that provides the "paper clip" effect. That is, the creation of diagonal tension results in a plurality of forces which grip the article in all directions. Moreover, orthogonal alignment of the article with the inner surfaces of the shipping container is achieved by opposing forces of diagonally positioned contact of the cushion on both the article and the box.

BRIEF DESCRIPTION OF THE DRAWINGS

Other objects, features and advantages of the invention will become apparent from the following detailed description of the invention when taken in conjunction with the accompanying drawings, in which:

FIG. 5 is an isometric view illustrating an embodiment of the inflatable packaging cushion of the present invention in its inflated form surrounding an article to be protected as it is used in combination with a shipping container;

FIG. 6 is an isometric view illustrating an inflated cushion of this invention under tension surrounding an article to be protected;

DETAILED DESCRIPTION OF THE PREFERRED EMBODIMENTS

Figure 2:
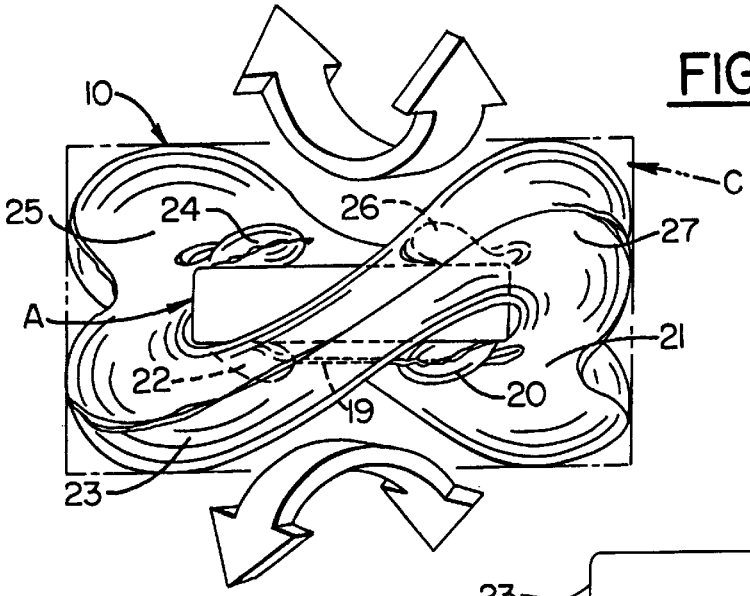
FIG. 2 is a side view taken along lines 2—2 of FIG. 5 illustrating the packaging cushion shown in FIG. 1 in its inflated form surrounding an article to be protected.

The present invention now will be described more fully hereinafter with reference to the accompanying drawings, in which preferred embodiments of the invention are shown. This invention may, however, be embodied in different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now to the drawings and in particular to FIG. 5, there is shown an inflatable packaging cushion 10 made in accordance with the present invention surrounding an article A and placed within a carton or box C. The inflatable cushion 10 is made from two sheets of thermoplastic material which are heat sealed together around their external peripheral edges 13 and is generally adapted to the dimensions of a box or carton C made from, for example, corrugated fiberboard.

Figure 1:
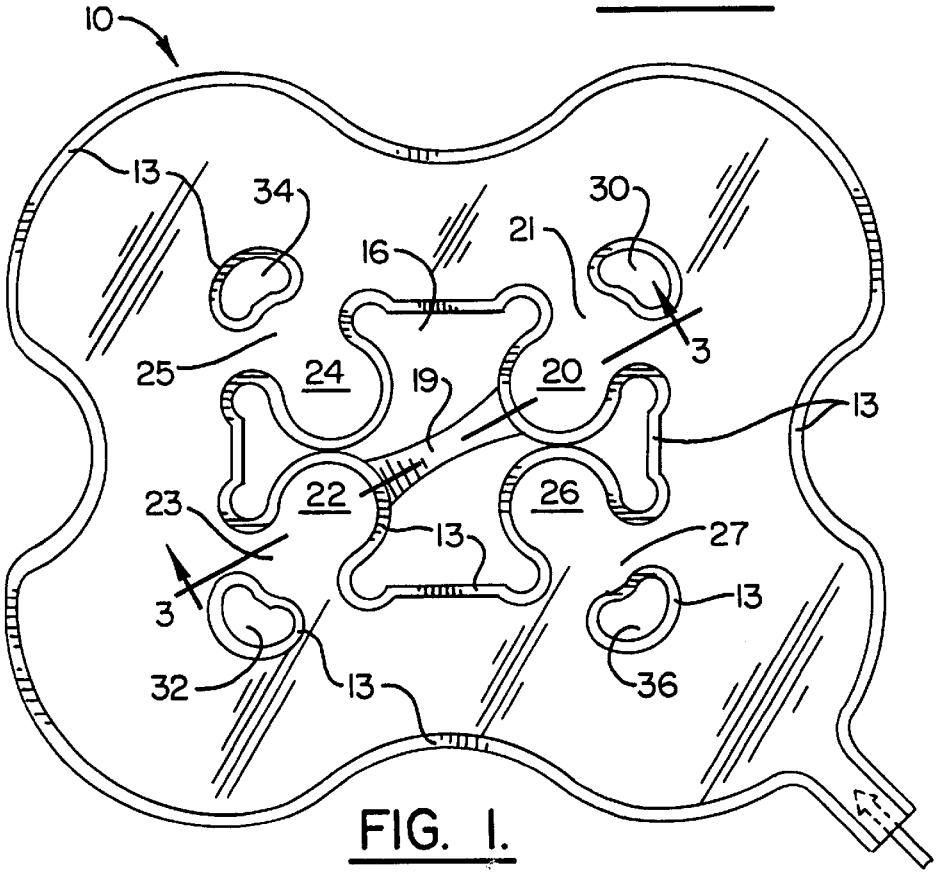
FIG. 1 is a plan view of one embodiment of the inflatable cushion made in accordance with this invention shown in its deflated state.

As shown by the embodiment of FIG. 1, the inflatable cushion 10 includes an internal opening 16, capable of receiving an article A to be cushioned such that the sides and ends of the article are completely encircled within protecting portions of the cushion. The inflatable cushion 10 is generally rectangular with an opening 16 in the interior of the cushion. Thus, the cushion forms four portions or interconnected chambers which surround and protect the sides and ends of the article A.

Figure 3:
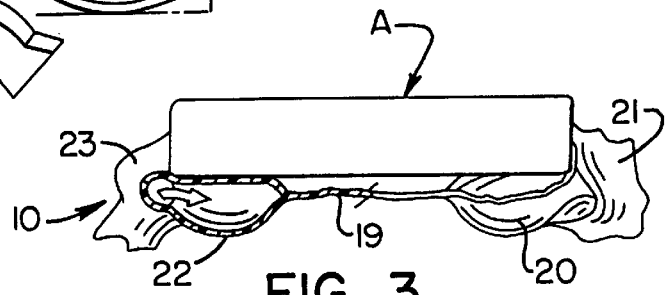
FIG. 3 is a view of the embodiment of the inflatable packaging cushion taken along lines 3—3 of FIG. 1.

At each corner of the cushion there is an arm 20, 22, 24, 26 extending inwardly into the internal opening 16. When the cushion 10 is at least partly inflated, the opposing arms work together as pairs. Arms 20 and 22 work together as a pair of arms, and arms 24 and 26 work together as a second pair of arms. The inflatable cushion 10 is designed so that when inflated, the article A is inserted in the internal area 16 so that one pair of arms 20 and 22 is on top of the article and the second pair of arms 24 and 26 is underneath the article providing an interlocking configuration creating diagonal tension on the article thereby snugly fitting the article within the open area. The second pair of arms 24 and 26 is provided with a film stringer or tie strap 19 between arms 20 and 22. The tie strap 19 may be a solid portion of thermoplastic material or it may be an inflatable chamber connecting each of the arms. As shown in FIG. 3, the tie strap 19 is positioned underneath the article to be protected and enables the person loading the article into the open area of the cushion better consistency in properly placing the article without the article slipping through the open area even during rough handling.

Figure 4:
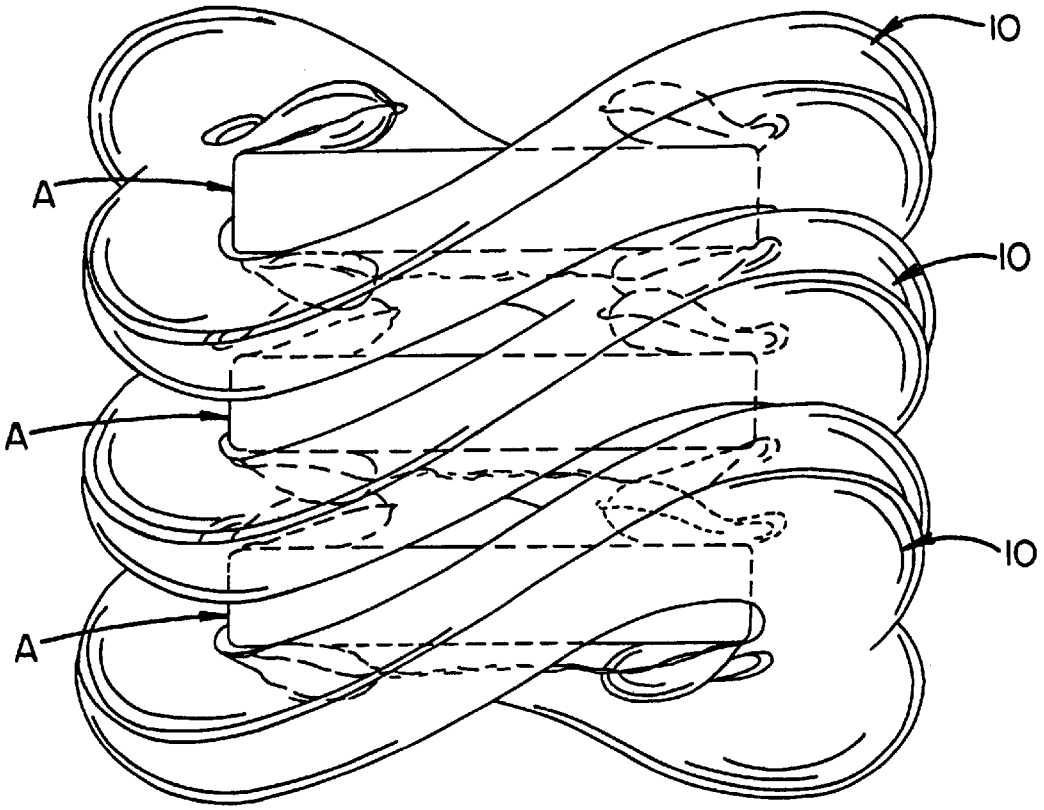
FIG. 4 illustrates a plurality of the inflated packaging cushions shown in FIG. 1 nested one on top of the other.

As shown in FIG. 2, the inflated cushion 10, having an article A positioned in the open area 16 therein, illustrates the flexible arch when twisted so as to fit on a product as shown by the arrows. This twisting also provides a nestable or stackable effect which makes it possible for the same cushion to be used in both single and multi-pack applications as shown more clearly in FIG. 4. In FIG. 4 there is shown a series of inflated cushions holding an article to be protected nestled one cushion on top of the other.

As can be seen in FIG. 2, the outer areas 21, 23, 25 and 27 of the cushion near the corner are somewhat larger in volume of air than are each of the arms. Because the outer areas 21, 23, 25 and 27 are larger than the respective arm, the cushion, if dropped or force is otherwise applied to the top or bottom of the cushion, the force will first be adsorbed by the larger outer areas 25 and 27. This will cause the air to be pushed to other parts of the cushion including, in this situation, arms 24 and 26, resulting in tensioning in the bottom portion of the cushion. Thus, when inflated, the arms form holding portions which come into contact with the top and bottom of the article holding it snugly in place. This action cushions all surfaces of the product with identical volumes or amounts of air. There are internal openings 30, 32, 34, and 36 at each of the corners of the cushion 10 which makes it easier to position the inflated cushion into a box. The edges of the thermoplastic sheets are sealed around each internal opening.

Protecting the top and the bottom of the article, the inflatable cushion of the subject invention transfers air within the structure easily and rapidly which is a critical part of the success of the product. For example, if air flow between communication chambers is constricted then this actually minimizes and reduces the amount of protection afforded the product.

The arms of the cushion which hold the article in place provide a gripping action similar to that of a paper clip. The transition from the flat configuration to the twisted position after the cushion has been inflated confining an article is shown in FIG. 2, i.e., the interlocking configuration, creates a diagonal tension that provides the "paper clip" effect. The tension created by the distortion causes the arms to grip the article due to the tendency of wanting to spring back to the original shape.

Due to the counteracting forces afforded by the diagonally located points of contact between the article, the cushion, and the outer box, the cushion design assures that the product's flat surfaces remain in parallel with the horizontal and vertical inner walls of the box.

This orthogonal alignment capability of the cushion design also enables the cushion to provide product protection even on corners and edges where no cushioning exists between the product and box. In such exposed areas, in order for a corner of the article to shift toward the inner wall of the box, it must overcome the stabilizing force of that portion of the cushion which is located diagonally opposite the area in question.

The design of the inflatable cushion creates a flexible arch in all six directions simultaneously when twisted so as to fit on an article to be protected. Another way to characterize the ability of this design to flex in all directions is to think of it as an inflated wave spring. Not only is a wave spring a flexible structure by design (in the top to bottom direction primarily) but it is also nestable or stackable.

The sheets of air impervious thermoplastic material which may be used includes any number of commercially available thermoplastic materials. As shown in FIG. 1, the sheets are juxtaposed over each other and sealed together in the region of their peripheral edges—i.e., weld lines 13. The sealing may be formed by conventional techniques, for example, heat sealing. In addition, the internal edges are welded in the same manner also along weld lines 13 and the cushion is cut to form the internal openings of the various embodiments. The thermoplastic sheets should be sufficiently flexible to adapt to the contours of the article and to be packaged and, at the same time, sufficiently robust not to be pierced by possible highly projecting or pointed parts of the article A to be protected. The cushions of these materials can be deflated and incinerated without release of toxic vapor, or they can be recycled. An inflation valve or other filling means 29 is provided for inflation with air. Upon filling, the valve may be sealed in a conventional manner. Alternatively, a one-way reusable valve may be used.

Figure 7:
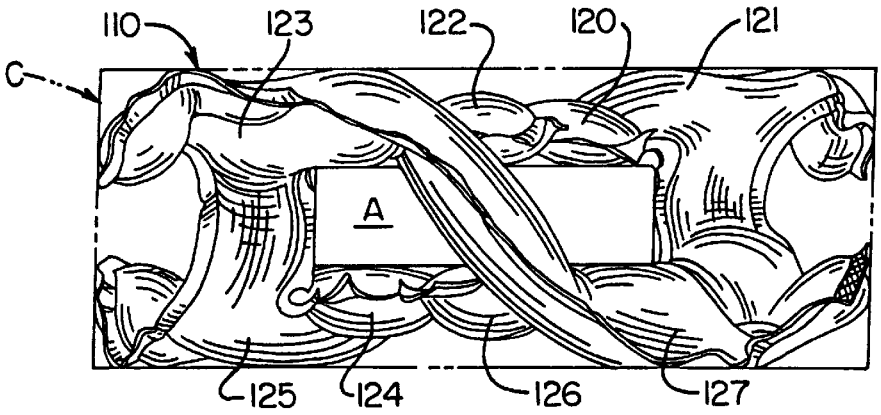
FIG. 7 is a view of the inflatable cushion of this invention surrounding an article to be protected.
Figure 8:
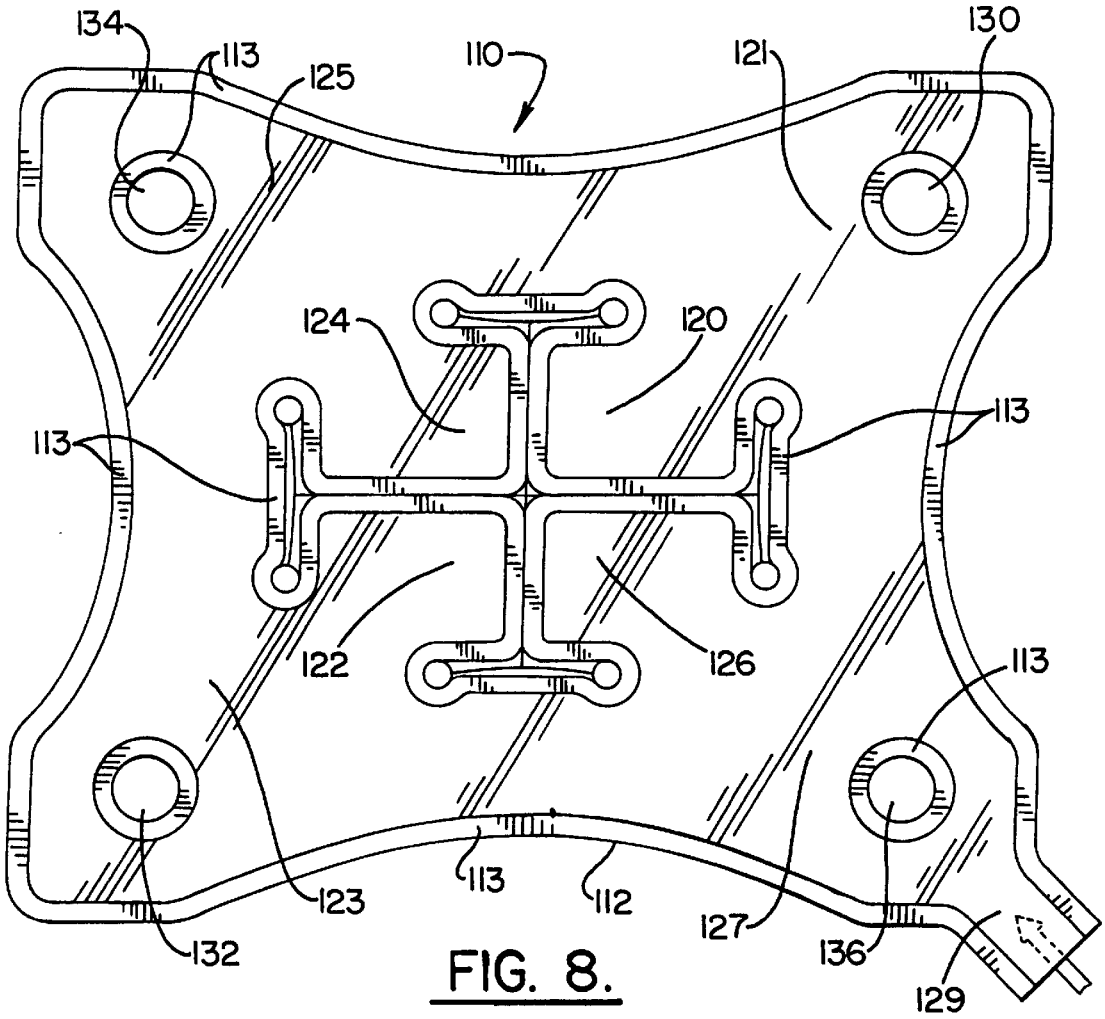
FIG. 8 is a plan view of one embodiment of the inflatable cushion of FIG. 6 made in accordance with this invention in its deflated state.

Another embodiment of the present invention is shown in FIGS. 6–8. The inflatable cushion 110 shown in FIG. 6 includes an internal opening 116, capable of receiving an article A to be cushioned such that the sides and ends of the article are completely encircled within protecting portions of the cushion. The inflatable cushion 110 is generally rectangular with an opening 116 in the interior of the cushion. Thus, the cushion forms four portions or interconnected chambers which surround and protect the sides and ends of the article A.

At each corner of the cushion there is an arm 120, 122, 124, 126 extending inwardly into the internal opening 116. When the cushion 110 is at least partly inflated, the opposing arms work together as pairs. Arms 120 and 122 work together as a pair of arms, and arms 124 and 126 work together as a second pair of arms. The inflatable cushion 110 is designed so that when inflated, the article A is inserted in the internal area 116 so that one pair of arms 120 and 122 is on top of the article and the second pair of arms 124 and 126 is underneath the article providing an interlocking configuration creating diagonal tension on the article thereby snugly fitting the article within the open area.

Figure 9:
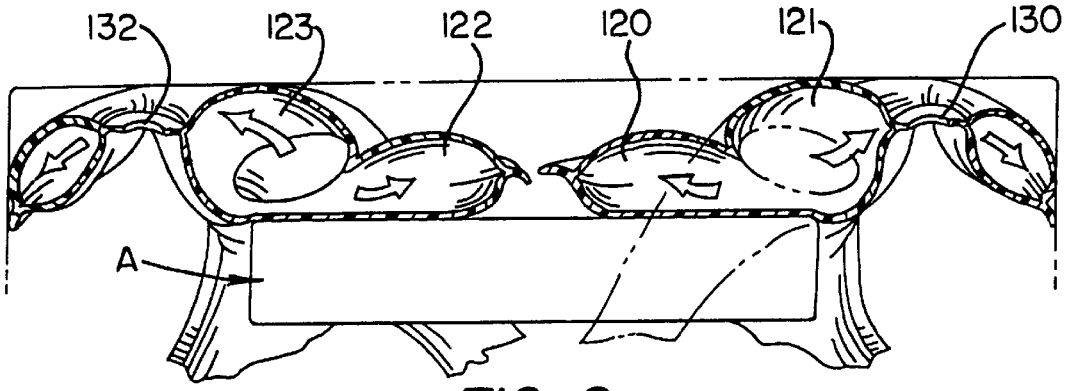
FIG. 9 is a view of the inflatable cushion of this invention taken along lines 9—9 of FIG. 6.
Figure 10:
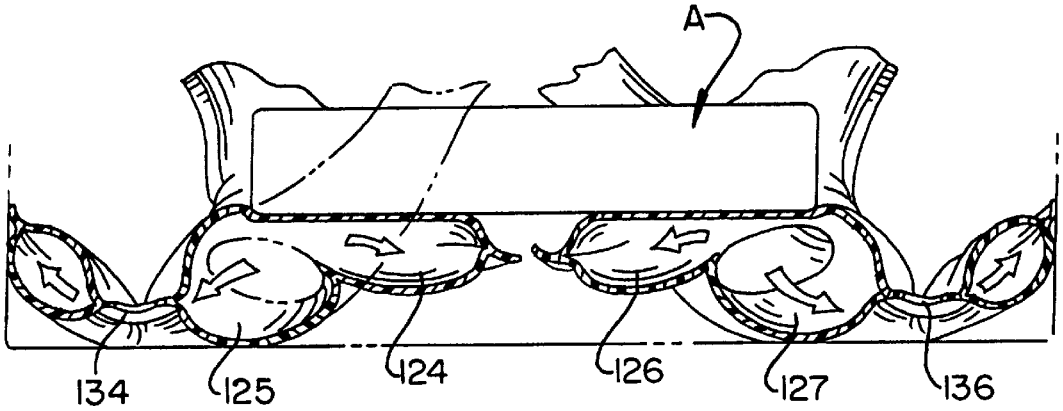
FIG. 10 is a view of the inflatable cushion of this invention taken along lines 10—10 of FIG. 6.
Figure 11:
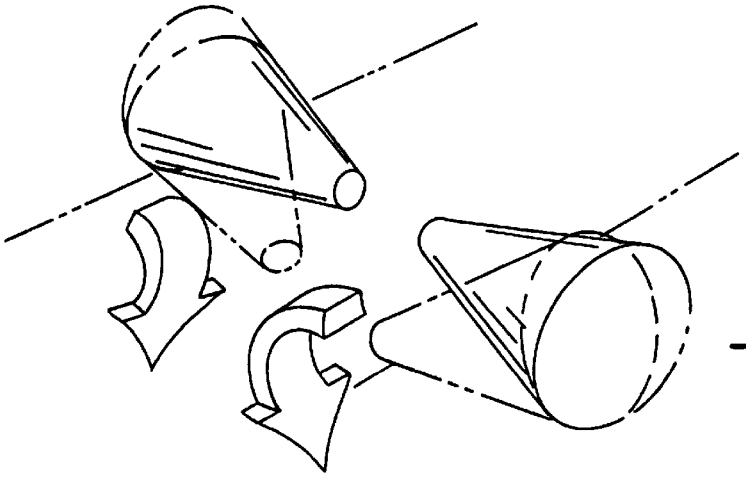
FIG. 11 illustrates the rotation of forces at opposite corners and arms when the cushion is inflated and subjected to forces, such as by dropping.

As can be seen in FIGS. 7, 9 and 10, the outer areas 121, 123, 125 and 127 of the cushion near the corner are somewhat larger in volume of air than are each of the arms. Because the outer areas 121, 123, 125 and 127 are larger than the respective arm, the cushion, if dropped or force is otherwise applied to the top or bottom of the cushion, the force will first be adsorbed by the larger outer areas 125 and 126 (if the force is to the bottom as shown in FIG. 10). This will cause the air to be pushed to other parts of the cushion including, in this situation, arms 124 and 126 resulting in tensioning in the bottom portion of the cushion as shown in FIG. 11 by the rotation of the arrows resulting in increased cushioning on the bottom. The same is true if force is applied to the top as shown in FIG. 9. Thus, when inflated, the arms form holding portions which come into contact with the top and bottom of the article, holding it snugly in place. This action cushions all surfaces of the product with identical volumes or amounts of air.

As shown in FIG. 6, there is an internal opening 130, 132, 134, and 136 at each of the corners of the cushion which makes it easier to position the inflated cushion into box C as shown by the arrows in FIG. 6. The edges of the thermoplastic sheets are sealed around each internal opening. The areas between the openings 130, 132, 134, 136 and the peripheral edge 112 of the corner form airways which may be used to wedge the inflated cushion into a box C in the manner shown in FIG. 7.

Figure 12:
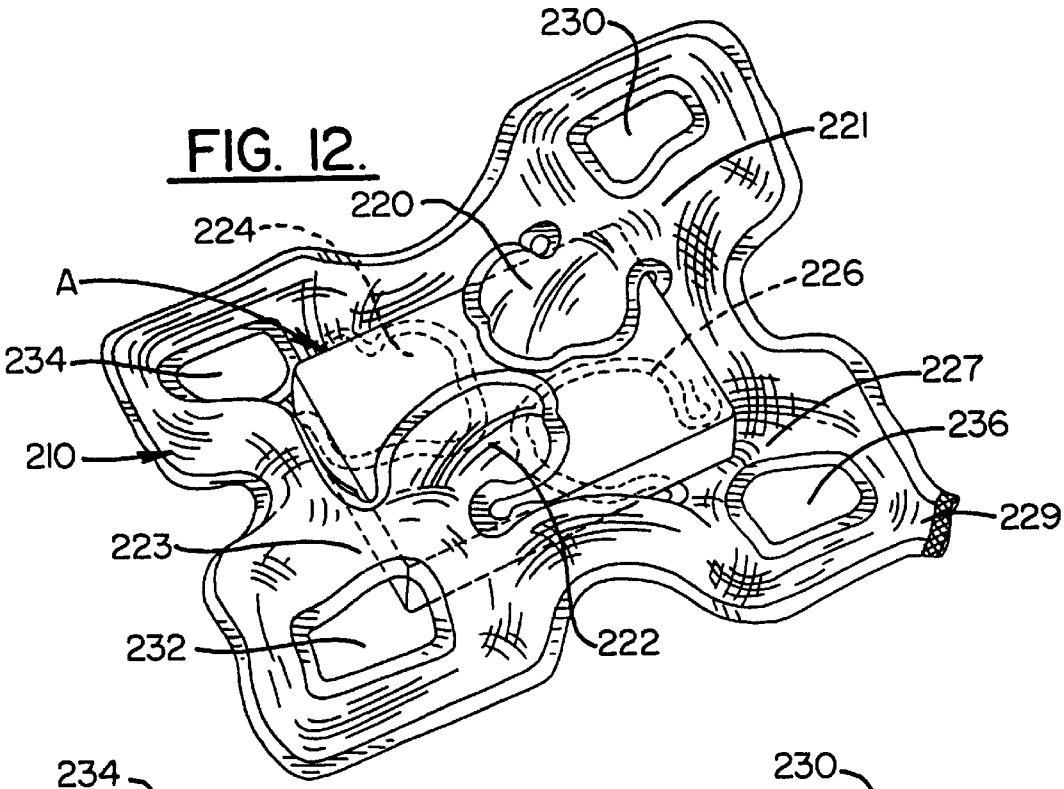
FIG. 12 is an isometric view illustrating another embodiment of an inflated cushion of this invention under tension surrounding an article to be protected.
Figure 13:
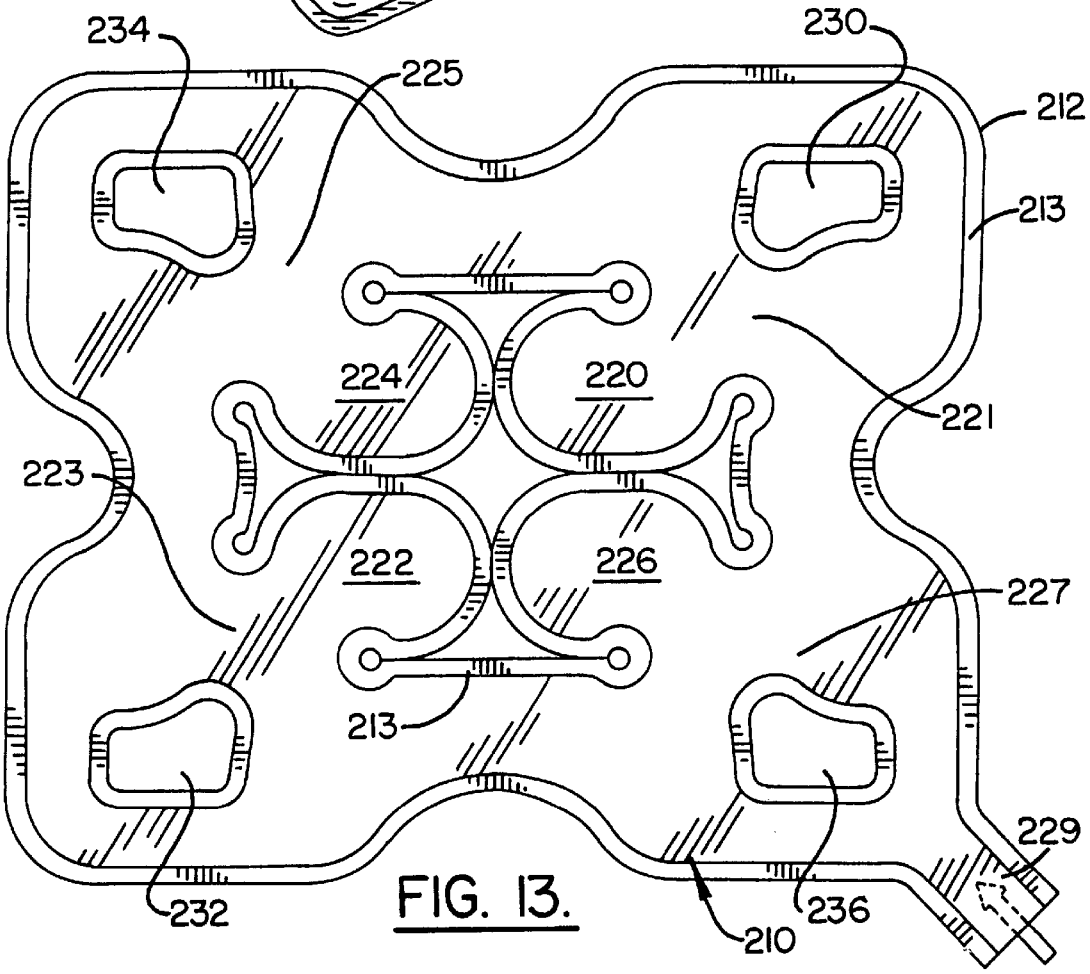
FIG. 13 is a plan view of the embodiment shown in FIG. 12 of an inflatable cushion made in accordance with this invention in its deflated state.

There is shown in FIGS. 12 and 13 another embodiment of an inflated cushion of this invention. This embodiment is constructed similarly to the embodiment of FIG. 6 but of a slightly different shape. The cushion 210, however, operates to protect article A in the same manner as the inflatable cushion described in FIGS. 1 and 6. This cushion, like that of FIGS. 1 and 6 is made of two sheets of thermoplastic material sealed around the periphery. In FIG. 12 there is shown the cushion 210 holding an article A in the interlocking position using a first pair of arms 220, 222 and a second pair of arms underneath the article 224 and 226. FIG. 13 shows a view similar to FIG. 8 of the cushion in its deflated condition. This embodiment also has outer areas 221, 223, 225, and 227 near the corners which contain somewhat larger volumes of air than each of the arms. Also, there is provided a series of internal openings 230, 232, 234, and 236 at each of the corners of the cushion which makes it easier to position the inflated cushion into a box. An inlet valve 229 is also provided.

Figure 14:
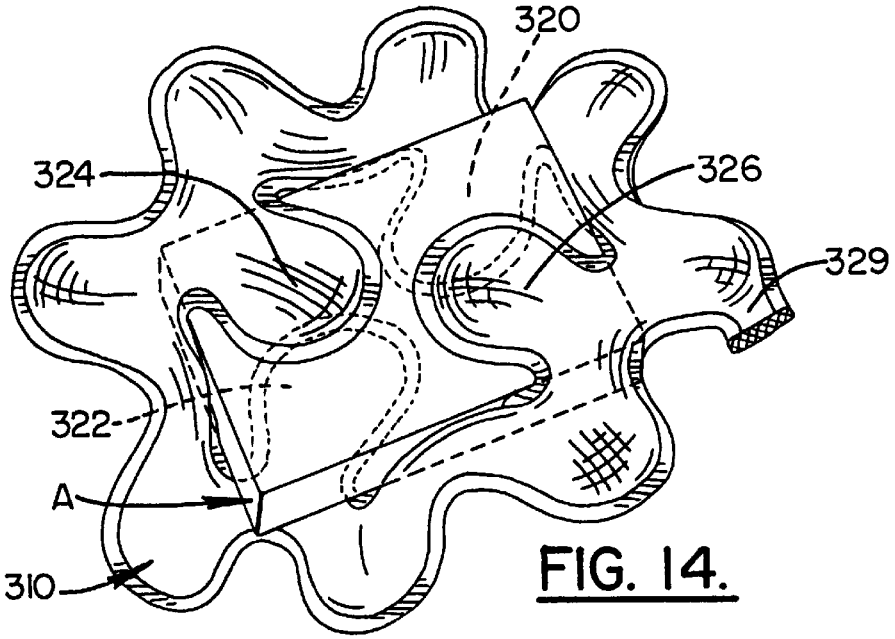
FIG. 14 is a further isometric view illustrating another embodiment of an inflated cushion of this invention under tension surrounding an article to be protected.
Figure 15:
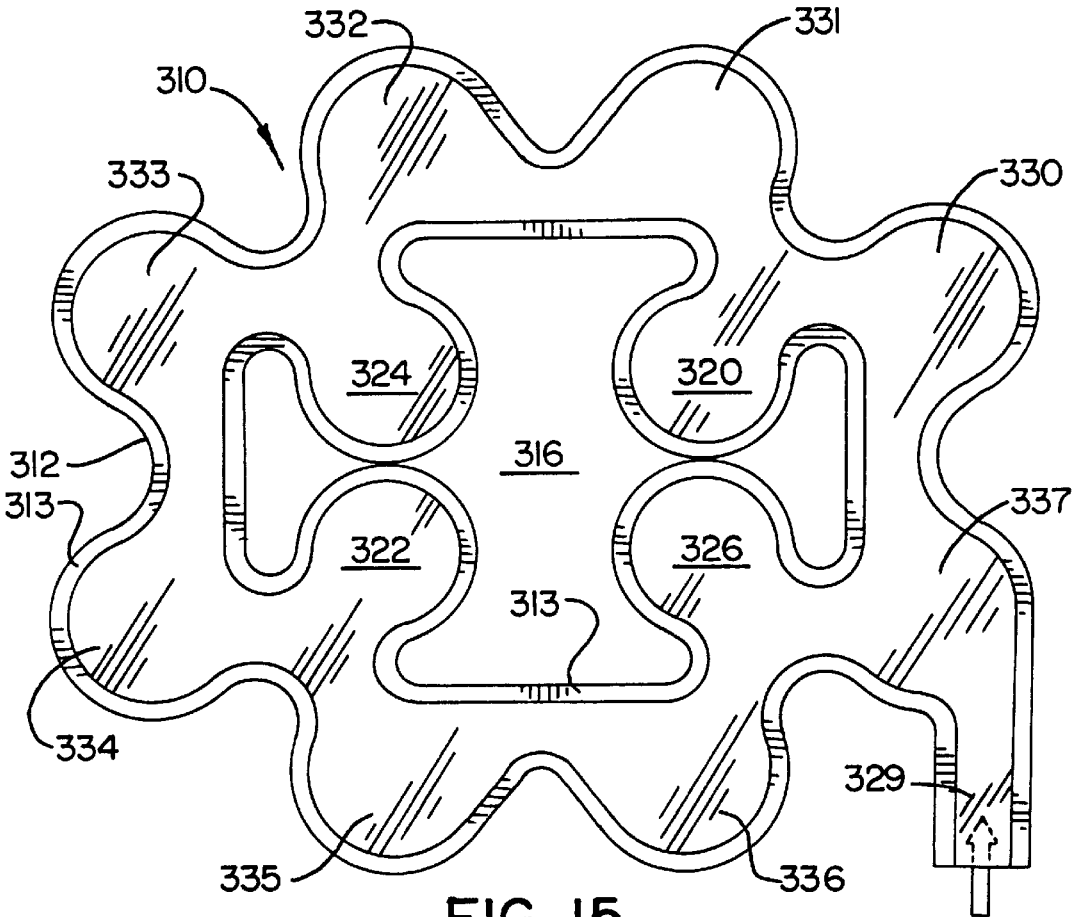
FIG. 15 is a plan view of the embodiment shown in FIG. 14 of another inflatable cushion made in accordance with this invention in its deflated state.

There is shown in FIGS. 14–15 yet another embodiment of the present invention which includes an inflatable cushion 310 having an internal opening 316 and containing a first pair of arms 320 and 322 and a second pair of arms 324 and 326. The inflatable cushion of the embodiment of FIGS. 14 and 15 is not rectangular at its periphery but instead has several outer portions which serve to wedge the cushion into an appropriate position within a box or container. This embodiment also has outer areas 320–337 near the external peripheral edge 312 which contain somewhat larger volumes of air than each of the arms. As shown in FIG. 15 the cushion in its deflated state also contains an air inlet valve 329.

Since multi-directional protection is achieved by twisting a single cushion shape around the article, rather than requiring multiple interconnected shapes to contact each product face (thus requiring more material in order to create those shapes), the cushion design of this invention achieves protection with an absolute minimum of material. Since the cushion design is one piece, rather than multi-piece, this feature makes it very easy to use. Ease of product insertion into the cushion is facilitated by the non-inflated film stringer (tie strap) which diagonally connects to the inflated arms.

The invention has been described in detail with particular reference to a preferred embodiment and the operation thereof but it should be understood that variations, modifications, and the substitution of equivalent means can be effected within the spirit and scope of the invention.

That which is claimed is:

1. A packaging system comprising in combination a shipping container, an article, and at least one inflatable packaging cushion of flexible material adapted to be at least partially charged with filler medium and adapted to the shape and dimension of said shipping container and adapted to protect said article comprising:

said cushion having corners and an internal opening said article to be shipped residing in said internal opening such that the sides and ends of said article are completely encircled within protecting portions of the cushion;

a first pair of inflatable arms extending inwardly into the area of said internal opening and positioned above and in contact with said article to protect the top of said article; and a second pair of inflatable arms extending inwardly into the area of said internal opening and diagonally located from said first pair of arms and positioned underneath and in contact with said article to protect the bottom thereof, said first pair of arms and said second pair of arms creating a gripping action to confine and cushion said article between said pairs of arms.

2. The inflatable packaging system according to claim 1 wherein there are a plurality of inflatable cushions stacked one on top of the other.

3. The inflatable packaging system according to claim 1 wherein said cushion comprises a pair of juxtaposed thermoplastic sheets having the outer peripheral edges thereof sealed together to form said cushion.

4. The inflatable packaging system according to claim 1 wherein the arms of said second pair of inflatable arms are connected to each other.

5. The inflatable packaging system according to claim 1 wherein said cushion is generally rectangular in shape.

6. The inflatable packaging system according to claim 1 wherein said areas near said corners are larger in volume than said arms such that when a force is applied to said cushion air will be forced from said external area into said arms.

7. The inflatable packaging system according to claim 1 wherein there is an internal opening in at least one of said corners.

8. The inflatable packaging system according to claim 1 wherein said filling medium is air.

* * * * *

UNITED STATES PATENT AND TRADEMARK OFFICE
CERTIFICATE OF CORRECTION

PATENT NO. : 6,076,677

DATED : June 20, 2000

INVENTOR(S) : Pozzo

It is certified that error appears in the above-identified patent and that said Letters Patent is hereby corrected as shown below:

Title page, item [75], in the Inventor's address, "Nevilly" should read --Neuilly--.

Column 6, line 63, after "opening" insert a comma (,).

Signed and Sealed this

Third Day of April, 2001

*Attest:*

Nicholas P. Godici

NICHOLAS P. GODICI

*Attesting Officer*

*Acting Director of the United States Patent and Trademark Office*